US010544535B2

(12) United States Patent
Jiang et al.

(10) Patent No.: US 10,544,535 B2
(45) Date of Patent: Jan. 28, 2020

(54) WASHING METHOD USING STEAM, AND WASHING MACHINE

(71) Applicant: QINGDAO HAIER DRUM WASHING MACHINE CO., LTD., Laoshan District Quingdao, Shandong (CN)

(72) Inventors: Yuliang Jiang, Shandong (CN); Xizhan Gong, Shandong (CN); Xinyu Zhao, Shandong (CN)

(73) Assignee: QINGDAO HAIER DRUM WASHING MACHINE CO., LTD., Shandong (CN)

( * ) Notice: Subject to any disclaimer, the term of this patent is extended or adjusted under 35 U.S.C. 154(b) by 0 days.

(21) Appl. No.: 16/070,270

(22) PCT Filed: Jan. 13, 2017

(86) PCT No.: PCT/CN2017/071172
§ 371 (c)(1),
(2) Date: Jul. 13, 2018

(87) PCT Pub. No.: WO2017/121393
PCT Pub. Date: Jul. 20, 2017

(65) Prior Publication Data

US 2019/0024290 A1 Jan. 24, 2019

(30) Foreign Application Priority Data

Jan. 14, 2016 (CN) ..... 2016 1 0023787

(51) Int. Cl.
*D06F 39/00* (2006.01)
*D06F 33/02* (2006.01)
(Continued)

(52) U.S. Cl.
CPC ..... *D06F 39/008* (2013.01); *D06F 17/12* (2013.01); *D06F 33/02* (2013.01); *D06F 39/006* (2013.01);
(Continued)

(58) Field of Classification Search
CPC ..... D06F 39/008; D06F 33/02; D06F 39/04; D06F 35/00; D06F 2202/04;
(Continued)

(56) References Cited

U.S. PATENT DOCUMENTS

2012/0266391 A1* 10/2012 Cho ..... D06F 35/006 8/137

FOREIGN PATENT DOCUMENTS

CN 1580353 A 2/2005
CN 1580369 A 2/2005
(Continued)

OTHER PUBLICATIONS

International Search Report for PCT/CN2017/071172 dated Mar. 31, 2017, with English translation.

*Primary Examiner* — Eisa B Elhilo
(74) *Attorney, Agent, or Firm* — Arent Fox LLP

(57) ABSTRACT

A washing method using steam and a washing machine are provided. The method includes: feeding water into an outer drum, and stopping feeding the water when a water inflow level reaches a preset water level, the preset water level is determined based on a position of an outer drum heating device and a position of a bottom of an inner drum, heating the water inside the outer drum, and stopping heating the water when it is heated for preset time or heated to a preset temperature, and performing a steam washing of the clothes.

13 Claims, 3 Drawing Sheets

(51) Int. Cl.
*D06F 17/12* (2006.01)
*D06F 39/08* (2006.01)

(52) U.S. Cl.
CPC ..... *D06F 39/087* (2013.01); *D06F 2202/08* (2013.01); *D06F 2202/085* (2013.01); *D06F 2204/04* (2013.01)

(58) Field of Classification Search
CPC ..... D06F 2204/04; D06F 2202/085; D06F 39/087; D06F 58/26; D06F 39/08; D06F 2220/00; D06F 39/045; D06F 75/12; D06F 2058/289; D06F 2058/387; D06F 58/263; D06F 37/304; D06F 71/34; D06F 75/06; D06F 17/12; D06F 39/006; D06F 2202/08
See application file for complete search history.

(56) References Cited

FOREIGN PATENT DOCUMENTS

| | | | | | |
|---|---|---|---|---|---|
| CN | 1989288 | * | 6/2007 | | |
| CN | 1989288 | A | 6/2007 | | |
| CN | 101235585 | A | 8/2008 | | |
| JP | 4784029 | B2 | 9/2011 | | |
| RU | 2322538 | C1 * | 4/2008 | ..... | D06F 33/02 |

* cited by examiner

WASHING METHOD USING STEAM, AND WASHING MACHINE

CROSS-REFERENCES TO RELATED APPLICATIONS

This application is a national stage application under 35 U.S.C. 371 based on international patent application PCT/CN2017/071172, filed on Jan. 13, 2017 which claims priority to a Chinese patent application No. 201610023787.2 filed on Jan. 14, 2016, disclosures of both of which are incorporated herein by reference in their entireties.

TECHNICAL FIELD

The present disclosure relates to a washing method technique, for example, to a washing method using steam, and a washing machine.

BACKGROUND

Interior of a drum washing machine includes an outer drum and an inner drum. The outer drum is provided with a heating tube, and the outer drum is used to store water for washing clothes. And the inner drum performs a beating-type washing when it rotates. The inner drum contains a number of small holes, the inner drum is used to isolate the clothes from washing water when spinning the clothes.

In related arts, a method of washing the clothes is generally carried out so that the washing water is heated at a main washing stage to promote activation of detergent to improve washing effect. However, the above washing method cannot achieve the purpose of stretching the clothes and removing wrinkles of the clothes, and the washing time is too long. There are also washing machines that use a steam generator to provide steam. The clothes to be washed are fully wetted by the washing water, and then a steam washing is performed, so as to allow the clothes to be stretched and remove wrinkles of the clothes. Meanwhile, time of the main washing by the steam washing is reduced. However, due to the fact that the clothes contain a large amount of moisture after being wetted, it is difficult for the clothes to absorb the steam, thereby reducing the effect of the steam washing. As a result, the washing time is still longer, and energy consumption is excessive.

SUMMARY

The present disclosure provides a washing method using steam and a washing machine. Before a pre-washing or a main washing is performed on clothes, water is fed into the outer drum, and such water is heated to generate a sufficient amount of steam to wash the clothes so that the clothes can be fully stretched, deodorized and sterilized. In addition, it is possible to reduce heating time for a normal washing process and achieve an effect of saving energy.

An embodiment of the present disclosure provides a washing method using steam, including: feeding water into an outer drum, and stopping feeding the water when a water inflow level reaches a preset water level, where the preset water level is determined based on a position of an outer drum heating device and a position of a bottom of an inner drum; heating the water inside the outer drum, and stopping heating when the water is heated for preset time or heated to a preset temperature; and performing a steam washing.

Optionally, the feeding the water to the outer drum, and stopping feeding the water when the water inflow level reaches the preset water level, includes: determining preset water inflow time based on the preset water level and a measured flow of the water and stopping feeding the water when the water inflow time reaches the preset water inflow time.

Optionally, the feeding the water to the outer drum, and stopping feeding the water when the water inflow level reaches the preset water level, includes: determining a preset total water inflow amount based on the preset water level, and stopping feeding the water when a total water inflow amount reaches the preset total water inflow amount.

Optionally, the feeding the water to the outer drum, and stopping feeding the water when the water inflow level reaches the preset water level, includes: determining whether the water inflow level reaches the preset water level based on feedback of a water level switch, and stopping feeding the water when the water inflow level reaches the preset water level.

Optionally, the preset water level is determined based on the position of the outer drum heating device and the position of the bottom of the inner drum includes: the preset water level is provided between a bottom of the outer drum and the bottom of the inner drum, and the outer drum heating device is submerged by the water at the preset water level.

Optionally, the performing a steam washing includes: driving, by a driving motor, the inner drum to rotate at a preset rotation speed and a rotation-to-stop ratio.

Optionally, the driving motor drives the inner drum to rotate at the preset rotation speed and the rotation-to-stop ratio simultaneously with the heating of the water inside the outer drum.

Optionally, after performing a steam washing, the method further includes: re-feeding the water to perform a pre-washing; and stopping the pre-washing and draining after the pre-washing is performed for preset washing time.

Optionally, after performing the steam washing or stopping the pre-washing and the draining, the method further includes: re-feeding the water and heating the fed water to perform a main washing.

An embodiment of the present disclosure also provides a washing machine, including an inner drum, an outer drum, an outer drum heating device, a water inflow valve, a driving motor and a controller, the outer drum is configured to receive water injected into the outer drum after the water inflow valve is opened so as to generate steam; the controller is configured to stop feeding the water when a water inflow level reaches a preset water level, the preset water level is determined based on a position of the outer drum heating device and a position of a bottom of the inner drum; the outer drum heating device is configured to heat the water in the outer drum; and the controller is further configured to control the outer drum heating device to stop heating when the water is heated for preset time or heated to a preset temperature, and control the driving motor to drive the inner drum to perform a steam washing.

Optionally, the preset water level is determined based on the position of the outer drum heating device and the position of the bottom of the inner drum includes: the preset water level is provided between a bottom of the outer drum and the bottom of the inner drum, and the outer drum heating device is submerged by the water at the preset water level.

Optionally, the water inflow valve is a solenoid valve.

Optionally, the outer drum heating device is a heating tube.

Optionally, the washing machine further includes a water temperature sensor disposed at the bottom of the outer drum.

Optionally, the washing machine further includes a liquid flow meter disposed at the position where the water inflow valve is disposed.

Before a pre-washing or a main washing is performed on the clothes, the water is fed into the outer drum, and such water is heated to generate a sufficient amount of steam to wash the clothes so as to fully stretch the clothes, and deodorize and sterilize them. In addition, by means of the steam washing, it is possible to reduce the amount of water consumed for the pre-washing or the main washing, reduce the heating time for the normal washing process, and achieve an effect of saving energy.

DETAILED DESCRIPTION

The technical solutions of the present disclosure are described below through alternative embodiments with reference to the accompanying drawings. The embodiments and the features in the embodiments may be combined with each other arbitrarily without conflicts.

First Embodiment

Figure 1:
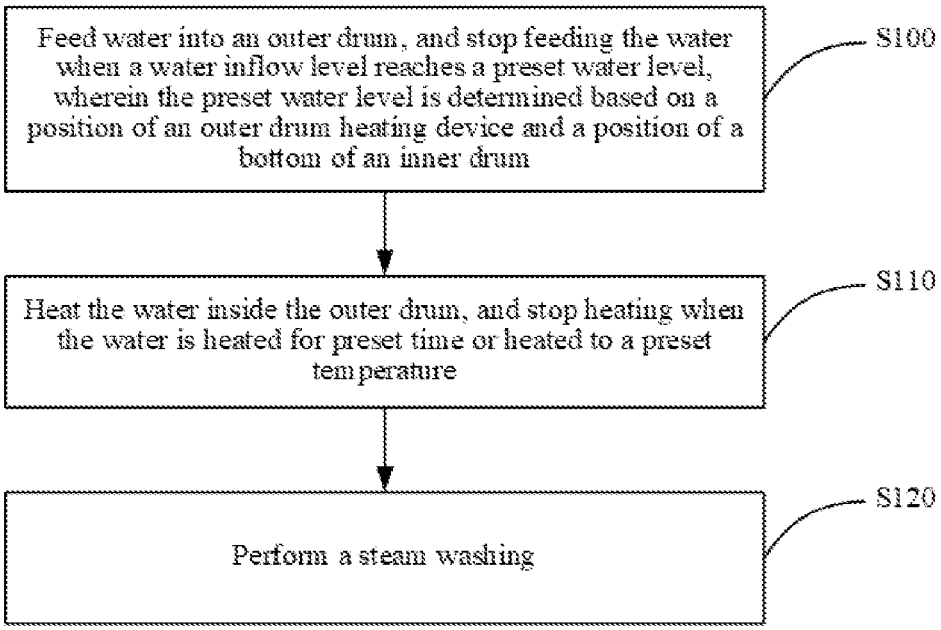
FIG. 1 is a schematic flowchart of a washing method using steam according to a first embodiment.

FIG. 1 is a schematic flowchart of a washing method using steam according to this embodiment. Referring to FIG. 1, the method includes: S100-S120.

In S100, water is fed into an outer drum, and the feeding of the water is stopped when a water inflow level reaches a preset water level, the preset water level is determined based on a position of an outer drum heating device and a position of the bottom of an inner drum.

That is, a water inflow valve of the washing machine is turned on, and the water enters the outer drum of the washing machine to be used for generating steam. In this embodiment, the water inflow valve may be a solenoid valve, and the water inflow valve may be closed or opened based on the control of a controller of the washing machine.

Before the water inflow valve is opened, a preset water level needs to be set, that is, a theoretical water inflow level which meets a requirement of the steam washing. In this embodiment, the preset water level is determined based on a position of an outer drum heating device and a position of a bottom of an inner drum. Optionally, the above-mentioned preset water level is provided between a bottom of the outer drum of the washing machine and the bottom of the inner drum of the washing machine, i.e., the fed water cannot enter the inner drum to wet the clothes, and the fed water needs to submerge the outer drum heating device so that the fed water can be heated by the outer drum heating device so as to be evaporated. Therefore, the steam enters the inner drum to steam the clothes in the inner drum.

After the water enters, the actual water inflow level is detected, and when the water inflow level is the same as the preset water level, the water inflow valve is closed, and the feeding of the water is stopped.

In this embodiment, the water inflow level may be determined based on water inflow time. That is, preset water inflow time is determined based on the preset water level and a measured flow of the water, and when the water inflow time reaches the preset water inflow time, the water inflow valve is closed, and the feeding of the water is stopped. The principle is as follows: a water inflow pipe is provided with the water inflow valve, the water inflow valve is a solenoid valve, and the water pressure is 0.02-1.0 Mpa; under the working condition, flow of the water measured by measuring devices such as a flow meter is a L/min±b % (where a and b are set according to situations); at this flow, if the solenoid valve is kept on for a certain period of time t, a certain volume of water can reach the preset water level, and then, the period of time t can be used as a water inflow parameter, i.e. the above-mentioned preset water inflow time; then, during actual use, when the water inflow time reaches the preset water inflow time, the water inflow valve can be closed to stop feeding the water.

In this embodiment, the water inflow level may also be determined based on the total water inflow amount, that is, the preset total water inflow amount is determined through the preset water level, and the water inflow valve is closed and the feeding of the water is stopped when the total water inflow amount reaches the preset total water inflow amount. The preset total water inflow amount is calculated based on the preset water level, a liquid flow meter is provided at the water inflow valve afterwards, and the total water inflow amount is measured by means of the liquid flow meter. The liquid flow meter is an instrument that measures and calculates the flow of the water measured by a water inflow solenoid valve and the total water inflow amount for certain time interval. It can be divided into instantaneous flow amount and cumulative flow amount (that is, the total water inflow amount). Instantaneous flow is the amount of water that passes through the effective cross section of the inflow pipe per unit of time, and the cumulative flow is the cumulative amount of the water that passes through the effective cross section of the inflow pipe for time interval. The cumulative flow amount (that is, the total water inflow amount) can be obtained by integration of the instantaneous flow amount with respect to time, and then the total water inflow amount is compared with the calculated preset water inflow amount.

The liquid flow meter in this embodiment is provided with an impeller and a sensor. When water flows through the sensor, the impeller is forced to rotate under the action of water, and rotation speed of the impeller is proportional to average flow velocity in a flow channel. At the same time, the blade periodically cuts the magnetic lines generated by an electromagnet and changes magnetic flux of coil. According to the electromagnetic induction principle, an electrical pulse signal will be induced in the coil, and frequency of the electrical pulse signal is proportional to the flow of fluid being measured. By measuring the water inflow amount with the aid of the flow meter, if the total water inflow amount measured within the unit time meets the requirement of the preset total water inflow amount corresponding to the preset water level, this numerical value will be sent to a computer control board of the washing machine. The computer control board issues an instruction to close the water inflow valve and stop feeding the water.

In this embodiment, the water inflow level may also be directly determined by a water level switch, that is, the water level switch is used to give a feedback on whether the water inflow level reaches the preset water level, and the feeding of the water is stopped when the water inflow level reaches the preset water level. The detection principle is as follows: the water level switch of the washing machine is used to detect and control the height of the water level in the washing drum. Optionally, an air chamber is provided on the washing machine, and pressure of the air chamber varies with the height of the water level in the washing machine drum. The air chamber is connected to the water level switch through a rubber hose. When the water level in the drum of the washing machine rises, the pressure in the air chamber increases, and an inner membrane piece of the water level switch is pulled up. When the water level rises to reach the preset water level, a contact in the water level switch is switched, a circuit is turned on, or an electric signal is transmitted to the computer control board of the washing machine, which further controls the water inflow valve to be closed to stop feeding the water.

In S110, the water in the outer drum is heated, and the heating is stopped when the heating is performed for preset time or heated to a preset temperature.

After it is detected that the water inflow level is equal to the preset water level and the water inflow is stopped, the outer drum heating device is turned on to heat the water in the outer drum and generate steam for the steam washing. In this embodiment, the outer drum heating device is a heating tube.

In order to better achieve the effect of saving energy, it is desirable to turn off the outer drum heating device after enough steam is generated for the steam washing. In this embodiment, preset time or preset temperature is set first. After the heating time reaches preset time, the outer drum heating device is turned off to stop heating. Alternatively, a water temperature sensor is provided at the bottom of the outer drum of the drum washing machine, and the temperature in the outer drum is detected by the water temperature sensor. When the temperature in the outer drum reaches the preset temperature, the outer drum heating device is closed to stop heating. As long as any one of the two conditions for closing the external drum heating device is met, the outer drum heating device can be closed.

In this embodiment, the preset time may be 15 minutes, and the preset temperature may be 65° C.

In S120, a steam washing is performed.

After the steam is generated, it enters the inner drum to moisten the clothes, and then the driving motor drives the inner drum to rotate at a preset rotation speed and a rotation-to-stop ratio, and the clothes is steam-washed. The speed of the above motor can be set as 45 rpm, and the rotation-to-stop ratio can be set as 10:5. After the motor rotates for a period of time, it will stop for a certain period of time and then start to rotate again, so that the clothes can fully receive the moist of the steam with a desired effect while the fiber is not damaged.

In this embodiment, the motor can rotate while the water is heated in the outer drum to generate steam, that is, when the steam begins to generate, the motor is controlled to drive the inner drum to rotate, and the steam washing is performed on the clothes, or after the heating is stopped, the motor is controlled to drive the inner drum to rotate, that is, after the generated steam meets the requirement, the steam washing is performed again. The former is optionally selected.

Second Embodiment

Figure 2:
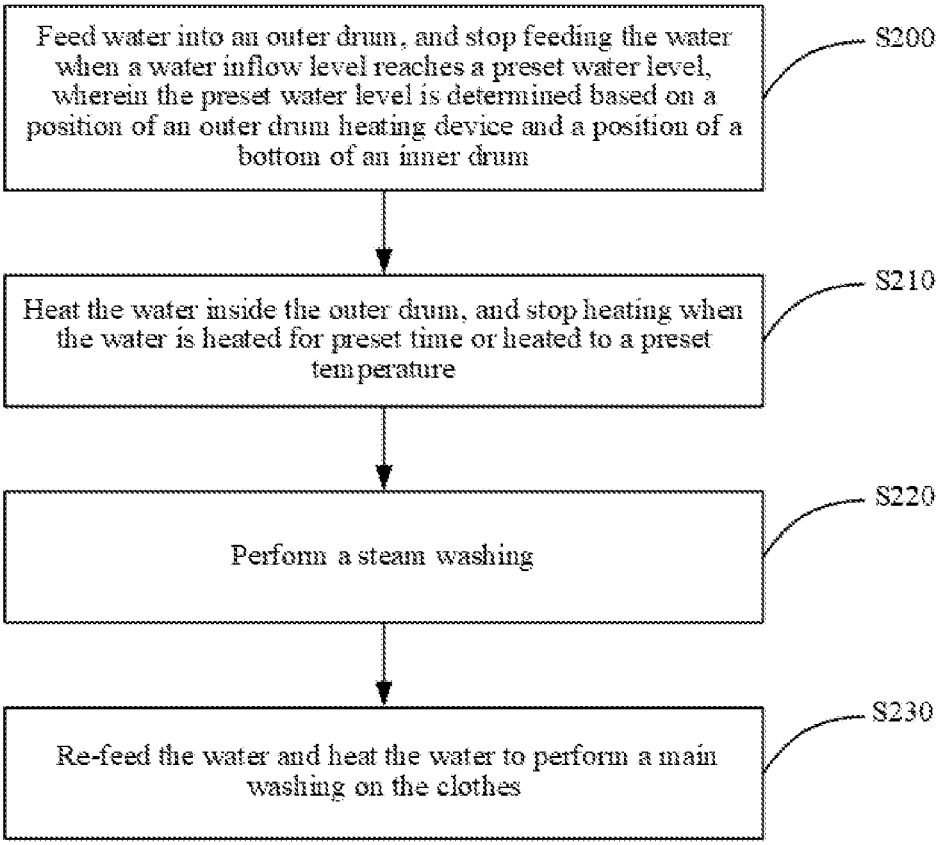
FIG. 2 is a schematic flowchart of a washing method using steam according to a second embodiment.

In this embodiment, a main washing process is added on the basis of the first embodiment. Optionally, referring to FIG. 2, a washing method using steam according to this embodiment includes S200-S230.

In S200, water is fed into the outer drum, and when the water inflow level reaches a preset water level, the feeding of the water is stopped, the preset water level is determined based on the position of the outer drum heating device and the position of the bottom of the inner drum.

In S210, the water in the outer drum is heated, and the heating is stopped when it is heated for preset time or heated to a preset temperature.

In S220, a steam washing is performed on the clothes.

In S230, the water is re-fed and the water is heated to perform a main washing on the clothes.

That is, after the steam washing performed on the clothes is completed, the water inflow valve is opened to continue to feed the water into the outer drum until the clothes are fully wetted and the water feeding is stopped. Then, the fed water is heated, and the heated washing is performed on the clothes, i.e., the above main washing process is performed.

In this embodiment, after the main washing is completed, the water is drained and enters a rinsing process. After the rinsing is completed, the water is drained, a spin-drying is performed on the clothes, and the washing of the clothes is finally completed.

In this embodiment, a steam washing is first performed to fully stretch the clothes, and deodorize and sterilize them, and then, the main washing is performed. This can reduce the water consumed in the main washing and reduce the heating time in the main washing process, thereby achieving the effect of saving energy.

Third Embodiment

Figure 3:
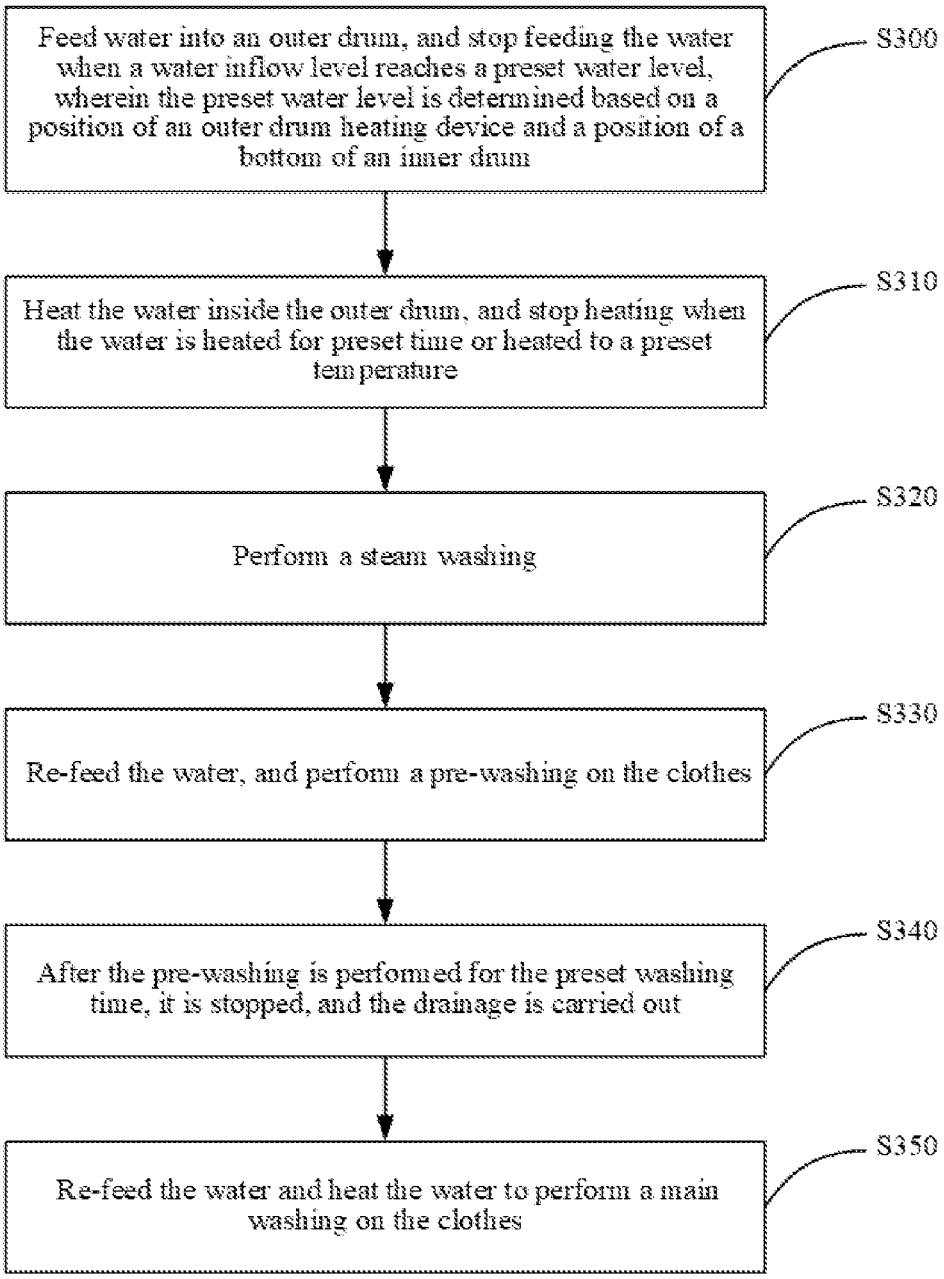
FIG. 3 is a schematic flowchart of a washing method using steam according to a third embodiment.

This embodiment is improved on the basis of the Second Embodiment. A pre-washing process is newly added. Optionally, referring to FIG. 3, a method for washing the clothes using steam according to this embodiment includes: S300-S350.

In S300, water is fed into the outer drum, and when the water inflow level reaches a preset water level, the feeding of the water is stopped. The preset water level is determined based on the position of the outer drum heating device and the position of the bottom of the inner drum.

In S310, the water in the outer drum is heated, and the heating is stopped when it is heated for preset time or heated to a preset temperature.

In S320, a steam washing is performed on clothes.

In S330, the water is re-fed, and the clothes are pre-washed.

Pre-washing refers to a washing process that removes dirty stains or larger particles from the clothes before the main washing is performed. After the steam washing is finished, the pre-washing procedure is selected. At this time, the water inflow valve is controlled to be opened again, and the water is fed into the outer drum. After the clothes are immersed in the fed water, the feeding of the water is stopped, and the pre-washing performed on the clothes is started.

In S340, after the pre-washing is performed for preset washing time, it is stopped, and the drainage is carried out.

Since in the pre-washing process, relatively dirty stains or larger particles on the clothes are removed prior to the main washing. The pre-wash time is set, i.e., the washing time is pre-set. In this embodiment, the preset washing time is 15 minutes. After the above preset washing time is reached, the pre-washing is stopped, and the washing water is discharged.

In S350, the water is re-fed, and the fed water is heated to perform a main washing on the clothes.

In the embodiment, after the steam washing performed on the clothes, a pre-washing process is newly added before the main washing. In the case of selecting the pre-washing function, the steam washing function may be performed first in the program, so that the pre-washing can be more easily to remove more dirt and more particles contained in the clothes.

Figure 4:
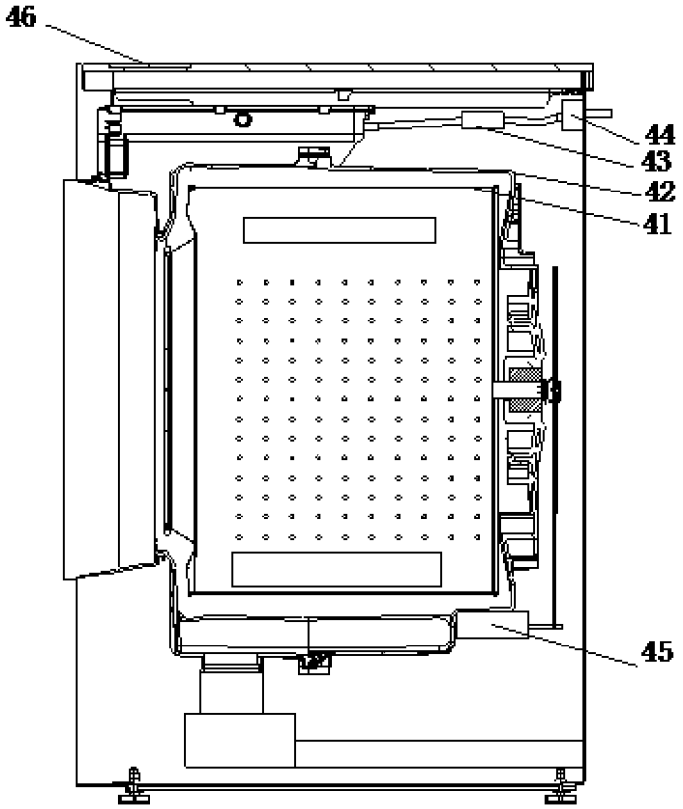
FIG. 4 shows a schematic structural view of a washing machine according to a third embodiment.

As shown in FIG. 4, in this embodiment, a washing machine is provided, which includes an inner drum 41, an outer drum 42, an outer drum heating device 43, a water inflow valve 44, a driving motor 45 and a controller 46.

The outer drum 42 is configured to receive water injected into the outer drum 42 after the water inflow valve 44 is opened so as to generate steam.

The controller 46 is configured to stop feeding water when the water inflow level reaches a preset water level, the preset water level is determined based on a position of the outer drum heating device 43 and the position of the bottom of the inner drum 41.

The outer drum heating device 43 is set to heat the water in the outer drum 42.

The controller 46 is further configured to control the outer drum heating device 43 to stop heating when it is heated for preset time or a preset temperature.

The driving motor 45 is controlled to drive the inner drum 41 to steam the clothes.

Optionally, the preset water level being determined by a position of an outer drum heating device 43 and a position of the bottom of the inner drum 41 includes:

The preset water level is provided between the outer drum 42 and the bottom of the inner drum 41, and the outer drum heating device 43 can be submerged by the water at the preset water level.

Optionally, the water inflow valve 44 is a solenoid valve.

Optionally, the outer drum heating device 43 is a heating tube.

Optionally, the washing machine further includes a water temperature sensor provided at the bottom of the outer drum 42.

Optionally, the washing machine further includes a liquid flow meter disposed at the water inflow valve 44. Optionally, the outer drum heating device 43 is provided between the water inflow valve 44 and the outer drum 42. Optionally, it can be provided on a water inflow pipe or on a water inlet.

The above-described embodiments of the present disclosure are merely examples for clearly explaining the present disclosure, and are not limited to the embodiments of the present disclosure. For those of ordinary skills in the art, other variations or changes may be made on the basis of the above description. There is no need and no exhaustion for all the embodiments.

What is claimed is:

1. A washing method using steam, comprising:

feeding water into an outer drum, and stopping feeding the water when a water inflow level reaches a preset water level, wherein the preset water level is determined based on a position of an outer drum heating device and a position of a bottom of an inner drum;

heating the water inside the outer drum, and stopping heating when the water is heated for preset time or heated to a preset temperature; and performing a steam washing;

wherein the performing the steam washing comprises driving, by a driving motor, the inner drum to rotate at a preset rotation speed and a rotation-to-stop ratio; wherein the driving motor drives the inner drum to rotate at the preset rotation speed and the rotation-to-stop ratio simultaneously with step of heating the water inside the outer drum; and wherein after the performing the steam washing, the method further comprises:

re-feeding the water to perform a pre-washing; wherein the pre-washing is a washing process that removes dirty stains or larger particles from clothes before a main washing is performed; and stopping the pre-washing and draining after the pre-washing is performed for preset washing time.

2. The method according to claim 1, wherein the feeding the water into the outer drum, and the stopping feeding the water when the water inflow level reaches the preset water level, comprises:

determining preset water inflow time based on the preset water level and a measured flow of the water and stopping feeding the water when the water inflow time reaches the preset water inflow time.

3. The method according to claim 1, wherein the feeding the water into the outer drum, and the stopping feeding the water when the water inflow level reaches the preset water level, comprises:

determining a preset total water inflow amount based on the preset water level, and stopping feeding the water when a total water inflow amount reaches the preset total water inflow amount.

4. The method according to claim 1, wherein the feeding the water into the outer drum, and the stopping feeding the water when the water inflow level reaches the preset water level, comprises:

determining whether the water inflow level reaches the preset water level based on feedback of a water level switch, and stopping feeding the water when the water inflow level reaches the preset water level.

5. The method according to claim 1, wherein the preset water level is provided between a bottom of the outer drum and the bottom of the inner drum, and the outer drum heating device is submerged by the water at the preset water level.

6. The method according to claim 1, wherein after performing the steam washing or the stopping the pre-washing and the draining, the method further comprises:

re-feeding the water and heating the fed water to perform the main washing.

7. A washing machine, comprising an inner drum, an outer drum, an outer drum heating device, a water inflow valve, a driving motor and a controller, wherein the outer drum is configured to receive water injected into the outer drum after the water inflow valve is opened;

the controller is configured to stop feeding the water when a water inflow level reaches a preset water level, wherein the preset water level is determined based on a position of the outer drum heating device and a position of a bottom of the inner drum;

the outer drum heating device is configured to heat the water in the outer drum so as to generate steam; and the controller is further configured to control the outer drum heating device to stop heating when the water is heated for preset time or heated to a preset temperature, and control the driving motor to drive the inner drum to perform a steam washing.

8. The washing machine according to claim 7, wherein the preset water level is provided between a bottom of the outer drum and the bottom of the inner drum, and the outer drum heating device is submerged by the water at the preset water level.

9. The washing machine according to claim 8, wherein the water inflow valve is a solenoid valve.

10. The washing machine according to claim 8, wherein the outer drum heating device is a heating tube.

11. The washing machine according to claim 8, further comprising: a water temperature sensor disposed at the bottom of the outer drum.

12. The washing machine according to claim 7, further comprising: a liquid flow meter disposed at the position where the water inflow valve is disposed.

13. The washing machine according to claim 9, further comprising: a liquid flow meter disposed at the position where the water inflow valve is disposed.

* * * * *